US007109881B2

(12) United States Patent
Blum et al.

(10) Patent No.: US 7,109,881 B2
(45) **Date of Patent: *Sep. 19, 2006**

(54) ELECTRONIC FLOOR DISPLAY WITH WEIGHT MEASUREMENT AND REFLECTIVE DISPLAY

(75) Inventors: Ronald D. Blum, Roanoke, VA (US); William Kokonaski, Gig Harbor, WA (US); Dwight Duston, Laguna Niguel, CA (US)

(73) Assignee: Intellimats LLC, Roanoke, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/231,772

(22) Filed: Sep. 22, 2005

(65) Prior Publication Data

US 2006/0049955 A1 Mar. 9, 2006

Related U.S. Application Data

(63) Continuation-in-part of application No. 11/199,130, filed on Aug. 9, 2005, and a continuation-in-part of application No. 11/002,276, filed on Dec. 30, 2004, (Continued)

(60) Provisional application No. 60/612,149, filed on Sep. 23, 2004, provisional application No. 60/599,878, filed on Aug. 10, 2004, provisional application No. 60/526,271, filed on Dec. 3, 2003, provisional application No. 60/441,408, filed on Jan. 23, 2003, provisional application No. 60/429,044, filed on Nov. 23, 2002, provisional application No. 60/428,387, filed on Nov. 23, 2002, provisional application No. 60/428,387, filed on Nov. 21, 2002, provisional application No. 60/385,579, filed on Jun. 5, 2002, provisional application No. 60/378,070, filed on May 12, 2002.

(51) Int. Cl.
*G08B 5/00* (2006.01)

(52) U.S. Cl. ..... 340/815.4; 177/25.13; 177/177; 340/691.6

(58) Field of Classification Search ..... 340/815.4, 340/815.53, 691.6; 177/25.11–25.13, 25.19, 177/177, 178

See application file for complete search history.

(56) References Cited

U.S. PATENT DOCUMENTS 2,191,704 A 2/1940 Bennett (Continued)

FOREIGN PATENT DOCUMENTS

DE 3147113 11/1981

(Continued)

OTHER PUBLICATIONS

U.S. Appl. No. 10/438,923, filed May 16, 2003.

(Continued)

*Primary Examiner*—Thomas Mullen
(74) *Attorney, Agent, or Firm*—Kenyon & Kenyon LLP

(57) ABSTRACT

Embodiments of the present invention relate to a floor display system comprising or associated with a weight measuring device. An output of the weight measuring device may be processed by electronic logic to display corresponding information on an electronic display device of the floor display system. The information may relate to the weight of an object on the floor display system, in particular, for example, the weight of a person standing on the floor display system. The floor display system may further be capable of displaying arbitrary content including graphical images and verbal information, where the content is changeable on demand. Embodiments of the present invention further relate to a floor display system with reflective properties.

20 Claims, 4 Drawing Sheets

Related U.S. Application Data which is a continuation-in-part of application No. 10/759,167, filed on Jan. 20, 2004, and a continuation-in-part of application No. 10/682,435, filed on Oct. 10, 2003, now Pat. No. 6,917,301, and a continuation-in-part of application No. 10/454,631, filed on Jun. 5, 2003, now Pat. No. 7,009,523, and a continuation-in-part of application No. 10/438,923, filed on May 16, 2003, now Pat. No. 6,982,649, and a continuation-in-part of application No. 10/285,639, filed on Nov. 1, 2002, now Pat. No. 6,873,266, which is a continuation of application No. 10/137,357, filed on May 3, 2002, now Pat. No. 6,507,285, which is a continuation of application No. 09/767,846, filed on Jan. 24, 2001, now Pat. No. 6,417,778, which is a continuation of application No. 09/418,752, filed on Oct. 15, 1999, now abandoned, which is a continuation of application No. 09/304,051, filed on May 4, 1999, now Pat. No. 6,219,876.

U.S. PATENT DOCUMENTS

| | | | | |
|---|---|---|---|---|
| 2,254,830 | A | 9/1941 | Schloss | |
| 2,282,672 | A | 5/1942 | Nelson | |
| 2,512,310 | A | 6/1950 | Corson | |
| 2,800,215 | A | 7/1957 | Bennett | |
| 2,843,868 | A | 7/1958 | Borgstorm | |
| 2,919,456 | A | 1/1960 | Spivey | |
| 3,078,490 | A | 2/1963 | Etcher | |
| 3,083,393 | A | 4/1963 | Nappi | |
| 3,141,522 | A | 7/1964 | Fitzpatrick | |
| 3,183,116 | A | 5/1965 | Schaar | |
| 3,300,275 | A | 1/1967 | Lorman | |
| 3,400,421 | A | 9/1968 | Nappi et al. | |
| 3,435,481 | A | 4/1969 | Kessler | |
| 3,501,797 | A | 3/1970 | Nappi | |
| 3,517,407 | A | 6/1970 | Wyant | |
| 3,578,738 | A | 5/1971 | Hughes | |
| 3,663,980 | A | 5/1972 | Conklin | |
| 3,665,543 | A | 5/1972 | Nappi | |
| 3,696,459 | A | 10/1972 | Kucera et al. | |
| 3,699,926 | A | 10/1972 | Stockl | |
| 3,717,897 | A | 2/1973 | Amos et al. | |
| 3,785,102 | A | 1/1974 | Amos | |
| 3,886,620 | A | 6/1975 | Miller et al. | |
| 3,906,578 | A | 9/1975 | Huber | |
| 3,909,996 | A | 10/1975 | Ettinger, Jr. et al. | |
| 3,916,401 | A | 10/1975 | Freeman | |
| 3,930,084 | A | 12/1975 | Shields | |
| 4,107,811 | A | 8/1978 | Imsande | |
| 4,126,854 | A | 11/1978 | Sheridon | |
| 4,143,103 | A | 3/1979 | Sheridon | |
| 4,143,194 | A | 3/1979 | Wihksne | |
| 4,328,275 | A | 5/1982 | Vargo | |
| 4,353,944 | A | 10/1982 | Tarui | |
| 4,421,809 | A | 12/1983 | Bish et al. | |
| 4,435,451 | A | 3/1984 | Neubert | |
| 4,439,474 | A | 3/1984 | Sagel | |
| 4,482,593 | A | 11/1984 | Sagel et al. | |
| 4,484,250 | A | 11/1984 | Rzepecki et al. | |
| 4,559,250 | A | 12/1985 | Paige | |
| 4,564,546 | A | 1/1986 | Jones | |
| 4,567,481 | A * | 1/1986 | Meier et al. | 345/50 |
| 4,576,244 | A | 3/1986 | Zeigner et al. | |
| 4,609,580 | A | 9/1986 | Rockett et al. | |
| 4,614,679 | A | 9/1986 | Farrington et al. | |
| 4,665,342 | A | 5/1987 | Topp et al. | |
| 4,707,895 | A | 11/1987 | Lang | |
| 4,720,789 | A | 1/1988 | Hector et al. | |
| 4,752,114 | A | 6/1988 | French | |
| 4,773,492 | A * | 9/1988 | Ruzumna | 177/25.19 |
| 4,798,754 | A | 1/1989 | Tomek | |
| 4,822,669 | A | 4/1989 | Roga | |
| 4,831,242 | A * | 5/1989 | Englehardt et al. | 177/25.19 |
| 4,853,678 | A | 8/1989 | Bishop, Jr. et al. | |
| 4,917,975 | A | 4/1990 | De Guzman | |
| 4,959,265 | A | 9/1990 | Wood | |
| 5,018,235 | A | 5/1991 | Stamatiou | |
| 5,071,628 | A | 12/1991 | Alazet | |
| 5,142,733 | A | 9/1992 | Mogez | |
| 5,161,041 | A | 11/1992 | Abileah et al. | |
| 5,204,159 | A | 4/1993 | Tan | |
| 5,293,660 | A | 3/1994 | Park | |
| 5,297,353 | A * | 3/1994 | Ghalayini | 40/503 |
| 5,335,788 | A | 8/1994 | Beasley et al. | |
| 5,344,693 | A | 9/1994 | Sanders | |
| 5,460,381 | A | 10/1995 | Smith et al. | |
| 5,461,748 | A | 10/1995 | Koiduka | |
| 5,500,267 | A | 3/1996 | Canning | |
| 5,556,685 | A | 9/1996 | Swicegood, Jr. | |
| 5,561,446 | A | 10/1996 | Montlick | |
| 5,562,580 | A | 10/1996 | Beasley et al. | |
| 5,571,626 | A | 11/1996 | Cumming et al. | |
| 5,589,246 | A | 12/1996 | Calhoun | |
| 5,604,027 | A | 2/1997 | Sheridon | |
| 5,613,313 | A | 3/1997 | Homan et al. | |
| 5,620,003 | A | 4/1997 | Sepponen | |
| 5,646,818 | A | 7/1997 | Hahn | |
| 5,658,637 | A | 8/1997 | Volz | |
| 5,703,564 | A | 12/1997 | Begum et al. | |
| 5,723,204 | A | 3/1998 | Stefik | |
| 5,747,133 | A | 5/1998 | Vinod et al. | |
| 5,805,117 | A | 9/1998 | Mazurek et al. | |
| 5,815,995 | A | 10/1998 | Adams | |
| 5,816,550 | A | 10/1998 | Watanabe et al. | |
| 5,826,874 | A | 10/1998 | Teitell et al. | |
| 5,839,976 | A | 11/1998 | Darr | |
| 5,848,830 | A | 12/1998 | Castle et al. | |
| 5,869,350 | A | 2/1999 | Heeger et al. | |
| 5,885,684 | A | 3/1999 | Hefner et al. | |
| 5,886,474 | A | 3/1999 | Asai et al. | |
| 5,945,502 | A | 8/1999 | Hsieh et al. | |
| 5,971,761 | A | 10/1999 | Tillman, Sr. | |
| 6,001,456 | A | 12/1999 | Newland | |
| 6,010,429 | A | 1/2000 | Prueitt | |
| 6,038,465 | A * | 3/2000 | Melton, Jr. | 177/25.19 |
| 6,084,526 | A | 7/2000 | Blotky et al. | |
| 6,219,876 | B1 | 4/2001 | Blum | |
| 6,233,776 | B1 | 5/2001 | Blum et al. | |
| 6,336,136 | B1 * | 1/2002 | Harris | 709/219 |
| 6,353,291 | B1 | 3/2002 | Borgogno et al. | |
| 6,387,061 | B1 * | 5/2002 | Nitto | 600/587 |
| 6,417,778 | B1 | 7/2002 | Blum et al. | |
| 6,538,215 | B1 * | 3/2003 | Montagnino et al. | 177/25.19 |
| 6,615,526 | B1 | 9/2003 | Pitcher et al. | |
| 6,617,530 | B1 * | 9/2003 | Lin | 177/25.19 |
| 6,641,139 | B1 | 11/2003 | Lamberti et al. | |
| 6,753,830 | B1 * | 6/2004 | Gelbman | 345/55 |
| 6,873,266 | B1 * | 3/2005 | Blum et al. | 340/815.4 |
| 6,914,540 | B1 | 7/2005 | Gongolas | |
| 6,917,301 | B1 | 7/2005 | Blum et al. | |
| 6,940,418 | B1 | 9/2005 | Blum et al. | |
| 6,963,035 | B1 | 11/2005 | Honda et al. | |
| 6,982,649 | B1 * | 1/2006 | Blum et al. | 340/815.4 |
| 2001/0011399 | A1 | 8/2001 | Blum et al. | |
| 2003/0066073 | A1 | 4/2003 | Rebh | |
| 2004/0004827 | A1 | 1/2004 | Guest | |
| 2004/0222026 | A1 * | 11/2004 | Kohn et al. | 177/177 |

FOREIGN PATENT DOCUMENTS

| | | |
|---|---|---|
| DE | 87 01 817.9 | 4/1987 |
| DE | 3 923 959 | 10/1990 |
| DE | 3 915 254 | 11/1990 |

| | | |
|---|---|---|
| DE | 40 06 781 | 9/1991 |
| DE | 4135877 | 5/1993 |
| DE | 298 11 821 | 10/1998 |
| EP | 0 009 891 | 4/1980 |
| EP | 0 188 005 | 7/1986 |
| EP | 0 199 537 | 10/1986 |
| EP | 0 202 846 | 11/1986 |
| EP | 0 353 139 | 1/1990 |
| EP | 0 354 281 | 2/1990 |
| EP | 0 359 478 | 3/1990 |
| EP | 0 365 869 | 5/1990 |
| EP | 0 374 860 | 6/1990 |
| EP | 0 421 258 | 4/1991 |
| EP | 0 448 768 | 10/1991 |
| EP | 0 512 904 | 11/1992 |
| EP | 0 514 191 | 11/1992 |
| EP | 0 554 641 | 8/1993 |
| EP | 0 573 277 | 12/1993 |
| EP | 0 624 125 | 11/1994 |
| EP | 0 624 681 | 11/1994 |
| EP | 0 648 834 | 4/1995 |
| EP | 0 721 176 | 7/1996 |
| EP | 0 751 213 | 1/1997 |
| EP | 0 794 244 | 9/1997 |
| EP | 0 839 900 | 5/1998 |
| EP | 0 895 745 | 2/1999 |
| EP | 0 971 064 | 1/2000 |
| FR | 2 532 095 | 2/1984 |
| GB | 319 416 | 9/1929 |
| GB | 433 133 | 8/1935 |
| GB | 2 182 242 | 5/1987 |
| GB | 2 263 003 | 7/1993 |
| JP | 4 144 532 | 5/1992 |
| JP | 6-90891 | 4/1994 |
| JP | 6 189 890 | 7/1994 |
| JP | 8056810 | 3/1996 |
| JP | 08-239988 | 9/1996 |
| JP | 10-057728 | 3/1998 |
| JP | 11-109901 | 4/1999 |
| JP | 2000-105558 | 4/2000 |
| JP | 2002-00059 | 7/2000 |
| WO | 91/08701 | 6/1991 |
| WO | 93/20536 | 10/1993 |
| WO | 00/07811 | 2/2000 |
| WO | 00/16682 | 3/2000 |
| WO | 00/79871 | 4/2000 |
| WO | 00/29209 | 5/2000 |
| WO | 01/27909 | 2/2001 |
| WO | 01/77746 | 10/2001 |
| WO | 02/11110 | 2/2002 |
| WO | 02/22972 | 3/2002 |
| WO | 02/065451 | 8/2002 |
| WO | 00/19871 | 4/2003 |

OTHER PUBLICATIONS

U.S. Appl. No. 10/454,631, filed Jun. 5, 2003.
U.S. Appl. No. 10/759,167, filed Jan. 20, 2004.
U.S. Appl. No. 11/002,276, filed Dec. 3, 2004.
U.S. Appl. No. 11/199,130, filed Aug. 9, 2005.
Patent Abstracts of Japan, vol. 1995, No. 05, Jun. 30, 1995 & JP 07 036395 A (Toray Ind Inc), Feb. 7, 1995.
Patent Abstracts of Japan, vol. 1997, No. 01, Jan. 31, 1997 & JP 08 239988 (Meitaku Syst:KK), Sep. 17, 1996.
Patent Abstracts of Japan, vol. 2002 & JP 2002 062832 A (Nippon Signal Co Ltd:The), Feb. 28, 2002.
Patent Abstracts of Japan, vol. 1995, No. 01, Feb. 28, 1995 & JP 06 299682 A (Jiyonsuton:KK), Oct. 25, 1994.
"Floor Graphics" Advertisements, Copyright 2002.
Protective Products Advertisement.
Sole-Parmer Advertisement.
3m Clean-Walk Mat., 5800 Series, TechnicalData, Jul. 1995.
Advertising Materials for Alma, (Advanced Laminated Material Applications, Inc.), ClenStep Contamination Control Mat, 12 pages, 1999.
"Displaying a Winning Glow", Michael Kenward, Technology Review, Jan./Feb. 1999, vol. 102, No. 1, 7 pages.
Screen Saviors, Michael Mattis, Business 2.0, Jul. 1999, 1 page.
"What's New", "Intelligent Ink", Advertising Material, Popular, 1 page, no date.
"Electronic Ink", Glen Sanders, ebooknet.com, 2 pages, Sep. 20, 1999.
MMR Journal, "Floor Decals New Wrinkle in P-O-P Ads", vol. 16, No. 10, p. 13, Apr. 5, 1999 USA.
Philadelphia Enquirer, "Cherry Hill, N.J. Firm Wants you to Look Down on Its Ads", Regional Newspaper, Aug. 27, 1998 USA.

* cited by examiner

ELECTRONIC FLOOR DISPLAY WITH WEIGHT MEASUREMENT AND REFLECTIVE DISPLAY

This application claims the benefit under 35 U.S.C. § 119(e) of U.S. provisional application Ser. No. 60/612,149, filed Sep. 23, 2004. Further, this application is a continuation-in-part of co-pending application Ser. No. 11/199,130, filed Aug. 9, 2005, which claims the benefit under 35 U.S.C. § 119(e) of U.S. provisional application Ser. No. 60/599,878, filed Aug. 10, 2004. Application Ser. No. 11/119,130 is a continuation-in-part of co-pending application Ser. No. 11/002,276, filed Dec. 3, 2004, which claims the benefit under 35 U.S.C. § 119(e) of U.S. provisional application 60/526,271, filed Dec. 3, 2003. Application Ser. No. 11/002,276 is a continuation-in-part of application Ser. No. 10/454,631, filed Jun. 5, 2003, and issued as U.S. Pat. No. 7,009,523 on Mar. 7, 2006, which claims the benefit under 35 U.S.C. § 119(e) of U.S. provisional application 60/385,579 filed Jun. 5, 2002. application Ser. No. 10/454,631 is a continuation-in-part of application Ser. No. 10/438,923, filed May 16, 2003, and issued as U.S. Pat. No. 6,982,649 on Jan. 3, 2006, which claims the benefit under 35 U.S.C. § 119(e) of U.S. provisional application 60/378,070, filed May 16, 2002. Application Ser. No. 10/438,923 is a continuation-in-part of application Ser. No. 10/285,639, filed Nov. 1, 2002, and issued as U.S. Pat. No. 6,873,266 on Mar. 25, 2005, which is a continuation of application Ser. No. 10/137,357, filed May 3, 2002, and issued as U.S. Pat. No. 6,507,285 on Jan. 14, 2003. Application Ser. No. 10/137,357 is a continuation of application Ser. No. 09/767,846, filed Jan. 24, 2001, and issued as U.S. Pat. No. 6,417,778 on Jul. 9, 2002. Application Ser. No. 09/767,846 is a continuation of application Ser. No. 09/418,752, filed Oct. 15, 1999, and now abandoned. Application Ser. No. 09/418,752 is a continuation-in-part of application Ser. No. 09/304,051, filed May 4, 1999, and issued as U.S. Pat. No. 6,219,876 on Apr. 24,2001. Moreover, this application is a continuation-in-part of co-pending application Ser. No. 10/759,167, filed Jan. 20, 2004, which claims the benefit under 35 U.S.C. § 119(e) of U.S. provisional application Ser. No. 60/441,408, filed Jan. 22, 2003. Application Ser. No. 10/759,167 is a continuation-in-part of application Ser. No. 10/682,435, filed Oct. 10, 2003, and issued as U.S. Pat. No. 6,917,301 on Jul. 12, 2005, which claims the benefit under 35 U.S.C. § 119(e) of U.S. provisional applications identified as follows: application Ser. No. 60/418,626, filed Oct. 12, 2002; application Ser. No. 60/428,387, filed Nov. 21, 2002; and application Ser. No. 60/429,044, filed Nov. 23, 2002. Application Ser. No. 10/682,435 is a continuation-in-part of co-pending application Ser. No. 10/438,923, filed May 16, 2003. Each of the above-identified applications and patents is incorporated herein in its entirety by reference.

BACKGROUND

U.S. Pat. No. 6,417,778 to Blum et al., which is fully incorporated herein by reference, describes an electronic display device associated with a floor, that enables conveying information via dynamic images and text. The present disclosure relates to various novel and advantageous features of such an electronic display device.

DETAILED DESCRIPTION

Figure 1A:
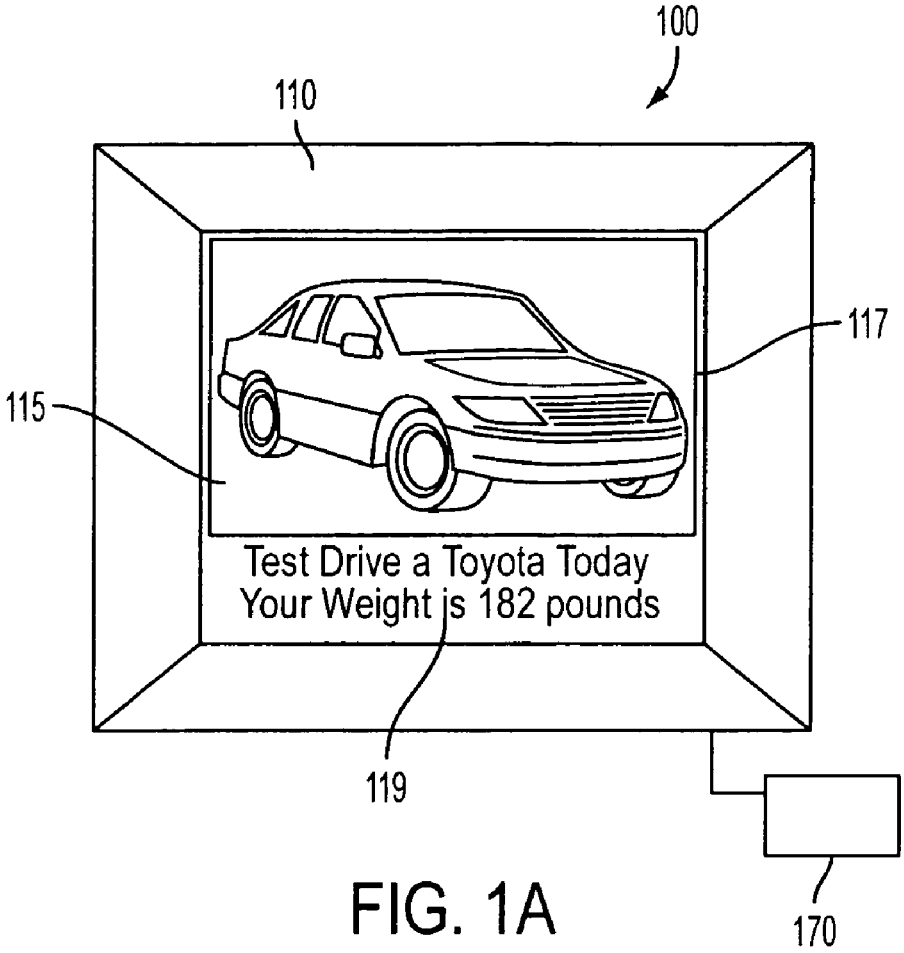
FIGS. 1A and 1B show a plan view and a side elevation view, respectively, of a floor display system comprising a weight measuring device according to embodiments of the present invention.

Embodiments of the present invention relate to a floor display system comprising or associated with a weight measuring device. In embodiments, the weight measuring device may include a scale. In other embodiments, the weight measuring device may include pressure sensors. An output of the weight measuring device may be processed by electronic logic to display corresponding information on an electronic display device of the floor display system. The information may relate to the weight of an object on the floor display system, in particular, for example, the weight of a person standing on the floor display system.

The information relating to weight may be, for example, a numerical value for the object's weight in some unit of measurement, say, pounds or kilograms and fractions thereof. In addition to information relating to weight, the floor display system may further be capable of displaying arbitrary content, distinct from the numerical weight value, including both static and dynamic (e.g. moving and changing) graphical images and verbal information (e.g. words and pictures). Because people are typically interested in knowing their weight, the floor display system could be used, for example, in commercial establishments to display advertising messages in conjunction with information concerning people's weight. To this end, embodiments of the present invention may further be capable of wired or wireless communication with a network. Via the network connection, messages on the floor display system may be changed, and new information may be added, at will or on demand. This could be advantageous, for example, in tailoring particular advertising messages to a target audience. For example, the content of the system's display could be updated so that, if a person's weight measured over a certain amount, an advertisement for a diet product such as Slim-Fast® or Weight Watchers®, or for a visit to a fitness club such as Gold's® gym, could be displayed.

Another useful application of a floor display system according to embodiments of the present invention would be in health care. For example, the floor display system could be deployed in doctors' offices, health care clinics, fitness clubs and the like. In such settings, the floor display system could be changeably configured to display content responsive to particular weight thresholds or ranges, for example. Thus, say, for a visitor to a doctor's office whose weight was within a particular range (e.g. a healthy range), the floor display system might display a first message and/or images (distinct from the weight measurement itself). This first message might be reassuring or complimentary, and/or advertise some activity or product associated with a healthy lifestyle. For a different visitor whose weight was in a different range (e.g. an unhealthy range) the floor display system might display a second message and/or images different from the first. This second message might be more in the nature of a warning about the health risks associated with being overweight, or encouragement to become more fit. The second message and/or images might, for example, advertise weight loss products or fitness clubs or cholesterol drugs or the like. There might be any number of predetermined weight ranges (e.g., 0–100 lbs., 100–150 lbs., 150–200 lbs., and so on, or finer gradations, e.g., 0–20, 20–40, . . . , 180–200, and so on, or cruder gradations, e.g., 0–100, 100–200, 200–300, and so on) for which the floor display system could be configured to generate corresponding content.

Since height is a factor in weight, to aid in the determination of whether a particular weight was in a healthy or unhealthy range, the floor display system may further include an input device, for example a keyboard or touchpad, whereby a person could enter his or her height. The floor display system may further include a sensing device to measure height automatically, without requiring manual input. The height value could be used by the floor display system in combination with the measured weight to make various determinations, such as whether the person's weight was in a healthy or unhealthy range.

As noted previously, embodiments of the present invention may further be capable of wired or wireless communication with a network. According to the embodiments, the communication may be two-way. That is, not only may content be downloaded via the network to the floor display system, but information may also be sent from the floor display system via the network to a remote location. The remote location could be, for example, a health care provider's office/database. Thus, for example, the floor display system could be deployed in a person's home (or health club or other location), and when the person weighed himself or herself, the measured weight value could be transmitted to and entered in the health care provider's database. This would avoid the need for the person to keep such records himself/herself for subsequent reporting to the health care provider. According to embodiments, the measured weight value could be transmitted, for example, in the form of electronic mail ("e-mail"). The transmission could be automatic or could be initiated by the person, for example using a keyboard or touch pad or other input device.

In embodiments, an electronic display device of the floor display system may include reflective properties. The reflective properties may improve visibility of a display on the display device, for example, when environmental illumination is poor.

FIG. 1A shows a floor display system 100 according to embodiments of the present invention. The system 100 may include a housing that comprises a transparent or translucent protective cover 115 bordered by an outer shell 110. The outer shell 110 may comprise sloping surfaces tapering to a thin edge. The housing may be capable of being walked over, where the sloping surfaces and thin edge act to reduce the likelihood of a person tripping over the display system. Further, the housing may be stood upon. The housing may enclose one or more electronic display devices 117 and protect it/them from damage. The floor display system 100 may further comprise a controller 170. The controller 170 may be internal or external to the housing.

Figure 1B:
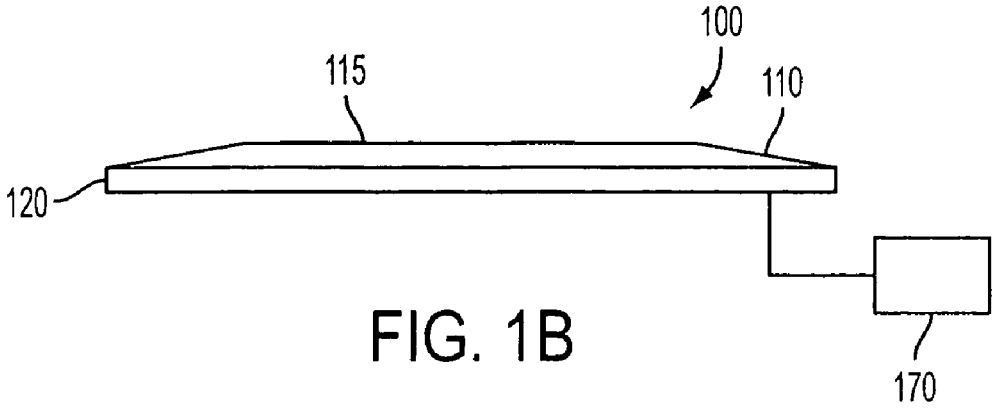

FIG. 1B shows a side elevation view of the floor display system 100. As illustrated, the floor display system 100 may further comprise a weight measuring device. In the embodiment of FIG. 1B, the weight measuring device is formed as a thin, flat scale 120. In use, the scale 120 may be arranged underneath the protective cover 115 and upper surfaces of the outer shell 110. The scale 120 may register the weight of an object, such as a standing person, on the protective cover 115 and upper surfaces of the outer shell 110, and generate an output, such as an electronic signal, corresponding to the weight of the object. The controller 170 may process the output and generate corresponding information 119 which is displayed on the electronic display device 117. See, for example, FIG. 1A, which shows the information "Your weight is 182 pounds" displayed on the display device 117. In the example of FIG. 1A, the display device is further displaying the graphical image of a car and the verbal information "Test Drive a Toyota Today."

The controller 170 may further be programmed to changeably generate content (e.g. words and pictures) of choice on demand, distinct from the weight measurement itself, responsive to weight thresholds/ranges, as described earlier.

Figure 2:
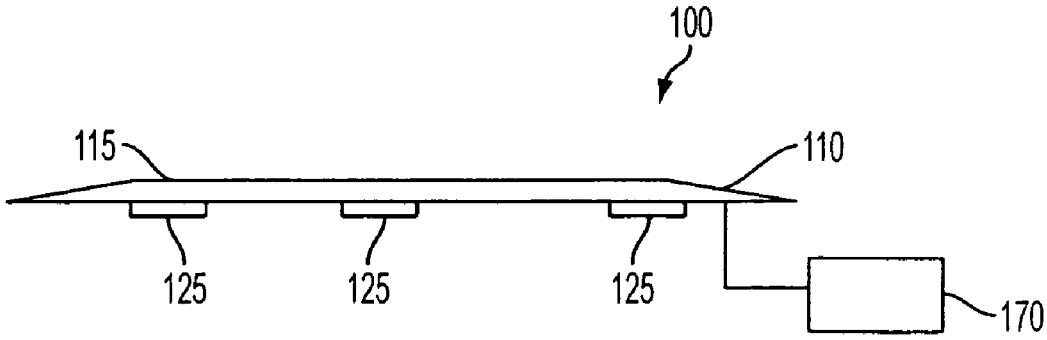
FIGS. 2, 3 and 3A show side elevation views of a floor display system comprising a weight measuring device according to alternative embodiments of the present invention.

A weight measuring device according to alternative embodiments of the present invention may comprise one or more pressure sensors 125, as shown in FIG. 2, which is another side elevation view of the floor display system 100. As with the thin flat scale 120, the sensors 125 may be arranged under the protective cover 115 and upper surfaces of the outer shell 110, and register the weight of an object on the protective cover 115 and upper surfaces of the outer shell 110. The sensors may generate an output which is translated by the controller 170 into information displayed on the display device 117. To process the output to obtain the displayed information, the controller 170 may, for example, perform calculations based on a calibration equation, or look up values in a table. The calibration equation and look-up table could be developed, for example, based on the placement of known weights on upper surfaces of the floor display system and corresponding outputs of the sensors.

Figure 3:
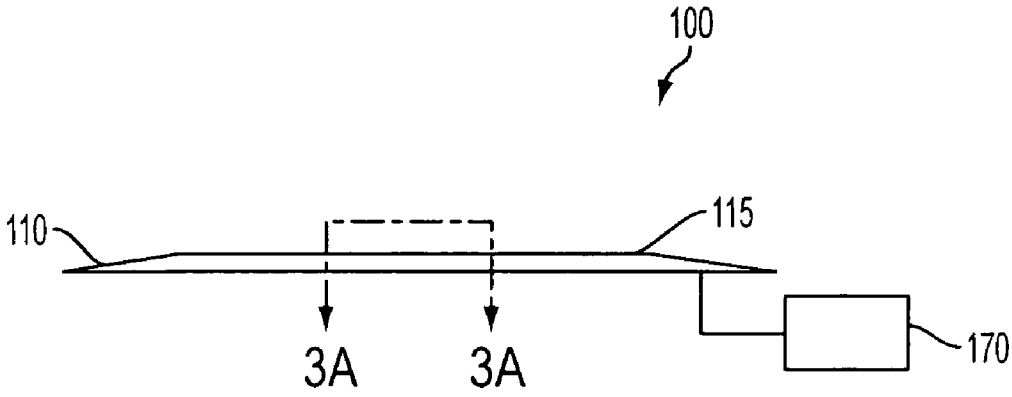
Figure 3A:
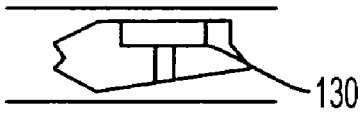

FIGS. 3 and 3A show a floor display system 100 with a weight measuring device according to still other alternative embodiments. FIG. 3 is side elevation view of the floor display system 100 and FIG. 3A shows an enlargement of a portion of the floor display system 100 in cutaway. Here, the weight measuring device includes one or more pressure sensors, springs or other apparatus 130 for registering weight. The weight measuring device may be contained within the housing. In embodiments as shown in FIGS. 3 and 3A, the protective cover 115 and outer shell 110 or portions thereof may be displaceable, compressible or deformable to a degree so as to transfer force to the weight measuring apparatus. The received force may be translated into an output which is processed by controller 170 to generate displayable information as described above.

The controller 170 may be coupled to the weight measuring device and to the electronic display device 117. The controller 170 may include any kind of electronic logic circuit, for example, a general microprocessor configurable with software, or an ASIC (application specific integrated circuit). The controller may be programmed with logic to process an output from the weight measuring device and generate a corresponding display on display device 117. The logic could include any kind of calculation or algorithm, but could at least partly involve translating a measurement of a physical effect (e.g. weight or pressure) registered by the weight measuring device into displayable information, such as weight in pounds or kilograms. As described in more detail further on, the controller 170 may be coupled to a storage medium storing, for example, control software for execution by the controller 170 and video content of choice for display, under the control of the control software, on the electronic display 117. The control software could cause the controller to generate selected content, distinct from the weight measurement itself, based on whether the weight measured by the weight measuring device was within a particular range.

As noted, in embodiments of the present invention the floor display system 100 may further comprise reflective properties. For example, the electronic display device 117 may include reflective display technologies such as reflective LCD (liquid crystal display), electronic ink displays, magnetic ink displays and digital ink displays, such as those developed by MagInk®. Such reflective display technologies may help improve visibility in poor illumination. For example, a display on the display device 117 could be clearly visible in daylight hours or under normal indoor lighting conditions, but less so at night or under poor indoor lighting conditions. Accordingly, the reflective technologies could be used in conjunction with a supplementary external light source make the display easier to see.

Figure 4:
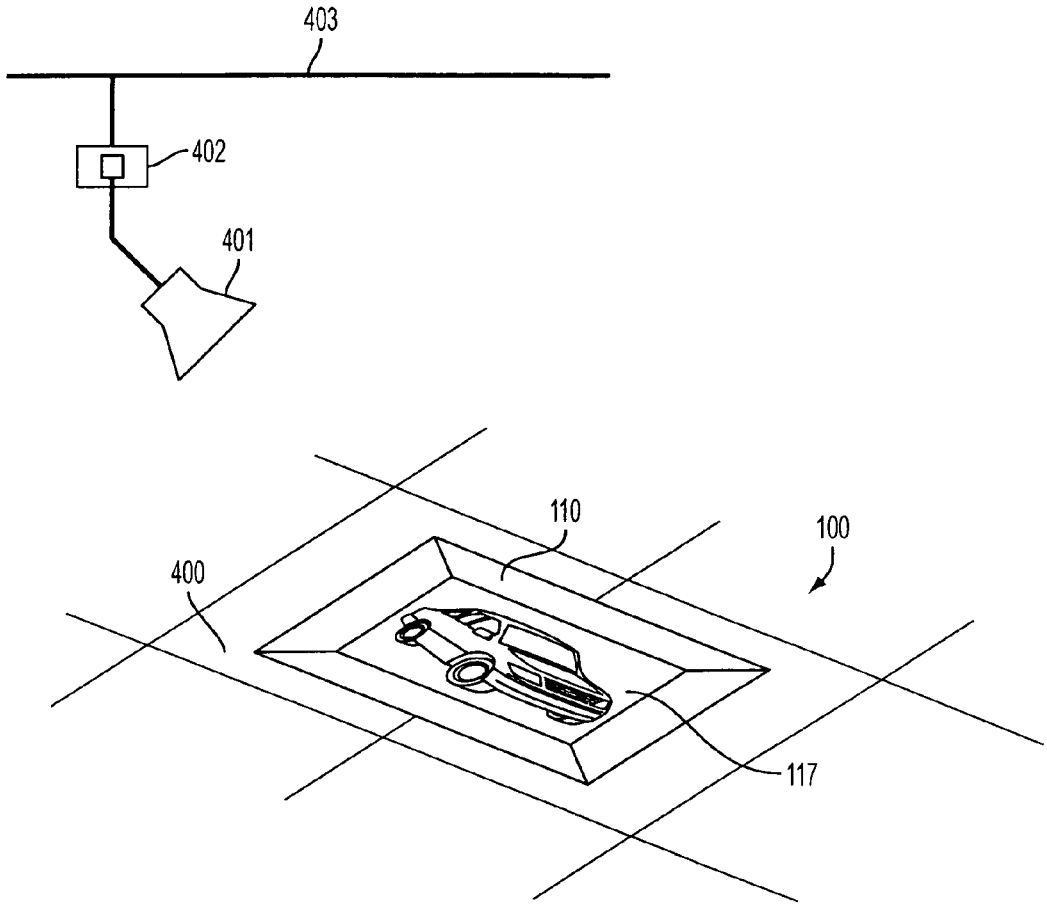
FIG. 4 shows a floor display system with reflective properties according to embodiments of the present invention.

This is illustrated in FIG. 4. FIG. 4 shows the floor display system 100 in place on a floor 400. The floor display system 100 has reflective properties. For example, the electronic display device 117 of the floor display system incorporates one or more reflective display technologies as in the above examples. A supplementary external light source 401 is further provided. The light source 401 may have a power source 402 and be movable along a track 403 mounted to the ceiling or a rafter, for example. By being movable along the track, the light source 401 can be moved along with the floor display system 100. At night or when environmental lighting is otherwise poor, the light source 401 could be directed at the floor display system 100, activating the reflective technologies therein to make a display more easily visible.

Advantages of reflective technologies as described above are at least twofold. First, they operate with less power than light-generating technologies. Second, some reflective technologies, such as MagInk® products, are bi-stable, which means power only needs to be applied to change the image on the display. Therefore, for still advertisements or other images, for example, power would only need to be applied to switch from one image to another. If this were done below some predetermined threshold frequency, the floor display system could, for example, be powered solely by a conservative power source such as built-in battery that was recharged from time to time.

As noted above, an electronic display device associated with a floor has been previously disclosed. More specifically, U.S. Pat. No. 6,417,778 discloses a system for electronically conveying information via an electronic display device associated with a floor. The electronic display device may incorporate a modifiable electronic display surface presenting for example, a liquid crystal display. The display could be connected to a computer and a computer generated image could be displayed on the display. Thus, the image displayed on the display could be modified by generating a different computer image and displaying that computer image on the display. The display could be associated with a base portion of a floor covering, such as included within a recess thereof, or could be included on a bottom surface, facing upward, of an insert portion of the floor covering. Alternatively, the display could be integrally formed with either of the base portion or the insert portion. The modifiable display could utilize a plurality of different graphics that can be displayed in any of a variety of manners on the display. For example, the graphics could be displayed in a generally fixed position on the display or could scroll across the display, with both exemplary methodologies displaying multiple graphics either individually or in combination.

Other alternatives for modifying graphics displayed on the floor covering include using light emitting polymers to create, and thus change, the graphics. The light emitting polymers can be either applied to, attached to, or woven into the floor covering. The light emitting polymers may be utilized on any portion of floor covering, for example, on either the base portion or the insert portion, or on any other portion of the different embodiments for the floor covering. Light emitting polymers are known and described in U.S. Pat. Nos. 5,945,502, 5,869,350, and 5,571,626, which are incorporated herein by reference in their entirety.

Other options for a display are to use electronic ink or electric paper. Electric paper is available from Xerox and is described in U.S. Pat. Nos. 5,723,204, 5,604,027, 4,126,854, and 4,143,103, which are incorporated herein by reference in their entirety. Electric paper employs thousands of tiny, electrically charged beads, called Gyricon, each about the width of a human hair, to create pixels. The two-tone beads are embedded inside a liquid-filled plastic sheeting that forms the surface of the paper. Each bead, half-black, half-white, gyrates in response to an electric field. Whether the beads are black- or white-side up determines the image. Because there's no need to refresh the image, and because the screen isn't backlit, electric paper uses only a fraction of the power used by conventional electronic displays. Electromagnetic styluses and printer-like devices can be used for getting images onto the paper.

Electronic ink is available from E Ink Corp., at 45 Spinelli Pl., Cambridge, Mass. 02138. Electronic ink uses a microencapsulated micromechanical display system. Tiny microcapsules are captured between two sheets of plastic to create pixels. Alternatively, the capsules may be sprayed on a surface. The result is a flexible display material. The tiny capsules are transparent and contain a mixture of dark ink and white paint chips. An electric charge is passed through the capsules. Depending on the electrostatic charge, the paint chips float at the top or rest on the bottom of each capsule. When the paint chips float at the top, the surface appears white. When they rest at the bottom, and thus under the ink, the surface appears black. Each of the two states is stable: black or white. A transparent electromagnetic grid laid over the sheet's surface controls the shape of the image. The display may be wirelessly connected to, for example, a computer and thus, the World Wide Web by utilizing, for example, a Motorola paging system. Text on all displays, if multiple displays are used, can be changed at once by a single editor, through a Web page.

Display technologies that may be utilized in embodiments of the present invention, in addition to those described above, include: light-emitting diodes (LEDs), organic light-emitting diodes (OLEDs), electroluminescent (EL) displays, plasma display panels (PDPs), field emission displays, ferroelectric displays (FEDs), light-emitting polymers, pixels, micro-encapsulated components, and optical fiber displays.

A floor display system as disclosed above may be used in places where there is foot traffic or other (for example, wheeled shopping cart) traffic, such as entryways to stores, public buildings or homes. In such environments, strong forces may be imparted to the floor display system by the foot traffic or other traffic. Techniques for suitably protecting the electronic display device from damage due to such forces and other factors have been disclosed. The techniques include using a tough, durable protective material such as tempered glass or plastic to cover the electronic display device. More sophisticated protective structures have also been disclosed. For example, U.S. patent application Ser. No. 10/454,631, which is fully incorporated herein by reference, describes a modular protective structure for an electronic display device associated with a floor.

As described in Ser. No. 10/454,631, an electronic display assembly may comprise a plurality of display modules. A coherent display may be presented on the plurality of display modules. That is, while individual display modules may present only fragments of a display, in the aggregate the plurality of display modules may present a complete or unified display. On the other hand, each of the modules could be configured to display unrelated images and/or text.

More specifically, a display module may be an electronic display device incorporating any display technology, including those disclosed herein, and others not specifically disclosed. A display module may be configured to electronically display graphical images and alphanumeric data in either a static (not moving or changing) or dynamic (e.g., scrolling or otherwise moving or changing) format. More specifically, a display module may be coupled by wired or wireless means to the controller 170 and modifiable via the controller to display any content chosen by a user. The controller 170 may be laterally arranged with respect to (i.e., to one or more sides of) the display modules. The display modules and the controller may be disposed so as to lie in substantially the same plane, and may both be thin and flat.

Figure 5:
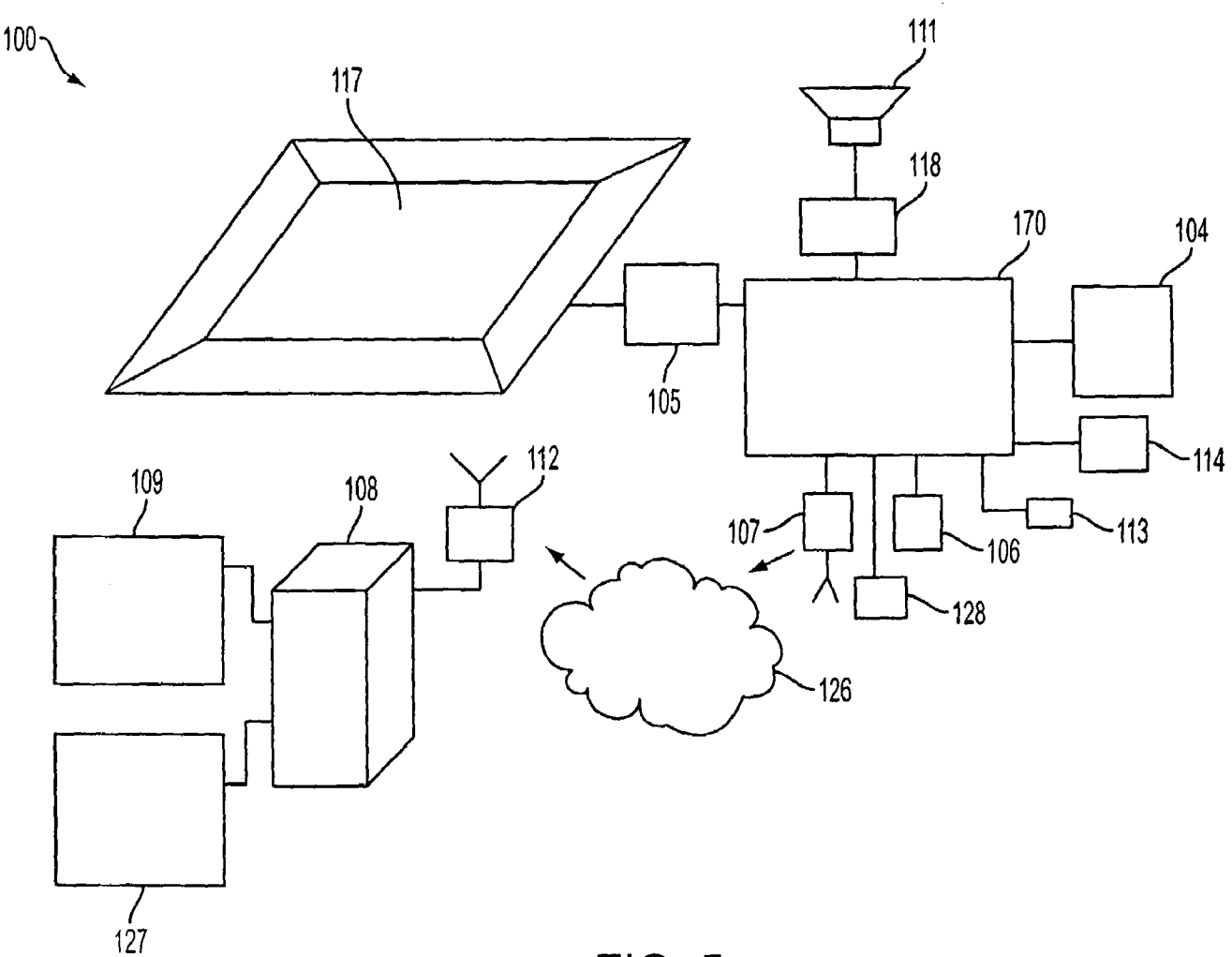
FIG. 5 shows further details of a floor display system according to embodiments of the present invention.

FIG. 5 shows further details of the floor display system 100. The controller 170 may be coupled to a storage medium 104, which could be any form of medium suitable for storing digital data, including RAM (random access memory), ROM (read-only memory), flash or other non-volatile solid-state electronic storage, EEPROM (electronically erasable and programmable read only memory), or magnetic and/or optical disk storage. The storage medium 104 may store, for example, control software for execution by the controller 170 and video content of choice for display, under the control of the control software, on the electronic display 117. A user interface 128, such as a personal computer with a display monitor and keyboard, may be coupled to the controller to enable configuration of the controller with specific user input, such as specific control programs to produce specific displays and/or audio output. The user interface 128 might further be used to, for example, enter a height value, initiate the transmission of a weight measurement to a remote location such as a health care provider's office/database, or the like. The user interface 128 may further include, or alternatively take the form of, an input device such as a touchpad with a view screen, or the like. An audio device 111, such as a loudspeaker, may further be coupled to the controller 103 via a sound card 118. The audio device 111 may output audio content of choice, stored in the storage medium 104, under the control of the controller 170. Components of the floor display system 100 may be powered by a power supply 114. The floor display system may further comprise a sensing device 113 to provide for a variety of interactive applications of the floor display system. The sensing device 113 could be coupled to the controller 113 and provide signals thereto. The connection of the sensing device to the controller could be wired or wireless.

Data may be stored in the storage medium 104 using, for example, a data port 106 coupled to a common system bus. The bus could be, by way of example only, a USB (Universal Serial Bus). The floor display system may further comprise a wireless port 107 implemented, for example, using a wireless WAN/LAN card. Through the wireless port 107, the floor display system 100 may be coupled to and communicate with a network 126. The network could be any kind of network, including a wide area network (WAN) such as the Internet, or a local area network (LAN) including, for example, other floor display systems. Through the network 126, the floor display system 100 may be coupled, for example, via a wireless communication device 112, to a server computer 108 of the network. The server computer 108 may be coupled to a database 109. The server computer 108 may further be coupled to remote location 127 such as a health care provider's office/database where the health care provider could receive, for example, e-mails reporting a person's weight. The database 109 may store information relevant to operation of the floor display system 100. For example, the database may contain video and audio content or control software that is downloadable to the storage medium 104 of the floor display system. Thus, the floor display system 100 may be remotely controllable. However, the floor display system 100 need not be networked, and could be controlled locally by, for example, downloading content and control software locally via data port 106. Also, while wireless communication methods and systems are illustrated in FIG. 5, wired systems could also be used, or could be combined with wireless systems.

Embodiments of the present invention may further include any combination of the features or properties disclosed in this application, or any of the features or properties of the applications incorporated herein by reference. For example, the floor display system may include both a weight measuring device and reflective properties. As further examples, the sensing device may be adapted to sense the presence of persons and perform an action in response, including variable image orientation and providing product information in response to customer queries.

Several embodiments of the present invention are specifically illustrated and/or described herein. However, it will be appreciated that modifications and variations of the present invention are covered by the above teachings and within the purview of the appended claims without departing from the spirit and intended scope of the invention.

What is claimed is:

1. A floor display system comprising:

an electronic display device having a protective cover capable of being walked over or stood upon; and a weight measuring device;

wherein the floor display system is capable of displaying arbitrary content including graphical images and verbal information, the content being changeable on demand, and of displaying information relating to the weight of an object measured by the weight measuring device, on the electronic display device.

2. The floor display system of claim 1, wherein the content relates to the weight of the object.

3. The floor display system of claim 1, wherein the weight measured is within a predetermined range, and the content corresponds to the range.

4. The floor display system of claim 1, wherein the weight measured is transmittable to a remote location.

5. The floor display system of claim 1, wherein the content is remotely controllable.

6. The floor display system of claim 1, wherein the content is changeable via a network.

7. The floor display system of claim 1, wherein the weight measuring device includes a scale.

8. The floor display system of claim 1, wherein the weight measuring device includes a pressure sensor.

9. The floor display system of claim 1, wherein the weight measuring device includes a spring.

10. The floor display system of claim 1, further comprising a controller to process an output of the measuring device and generate corresponding information for display on the electronic display device.

11. The floor display system of claim 1, wherein a housing of the floor display system is deformable to transfer a force to the weight measuring device.

12. The floor display system of claim 1, wherein the floor display system includes reflective properties.

13. A floor display system comprising:

an electronic display device;

wherein the floor display system is capable of displaying arbitrary content including graphical images and verbal information on the electronic display device, and further wherein the electronic display device includes a reflective technology.

14. The floor display system of claim 13, wherein the reflective technology includes reflective LCD.

15. The floor display system of claim 13, wherein the reflective technology includes electronic ink.

16. The floor display system of claim 13, wherein the reflective technology includes magnetic ink.

17. The floor display system of claim 13, wherein the reflective technology includes digital ink.

18. The floor display system of claim 13, further comprising a supplementary light source to activate the reflective technology.

19. The floor display system of claim 18, wherein the supplementary light source is movable along a track.

20. The floor display system of claim 13, further comprising a weight measuring device, wherein the floor display system is further capable of displaying information relating to the weight of an object measured by the weight measuring device on the electronic display device.

* * * * *